US005224705A

United States Patent [19]

Scheie et al.

[11] Patent Number: 5,224,705

[45] Date of Patent: Jul. 6, 1993

[54] GOLF CLUB HEAD WITH HIGH TOE AND LOW HEEL WEIGHTING

[75] Inventors: Carl E. Scheie, Libertyville, Ill.; Thomas F. Hardman, Palm Beach Gardens, Fla.; Robert A. Mendralla, Bloomingdale, Ill.

[73] Assignee: Wilson Sporting Goods Co., Chicago, Ill.

[21] Appl. No.: 891,239

[22] Filed: May 29, 1992

Related U.S. Application Data

[63] Continuation of Ser. No. 558,606, Jul. 26, 1990, Pat. No. 5,120,062.

[51] Int. Cl.[5] ..... A63B 53/04

[52] U.S. Cl. ..... 273/77 A; 273/167 F; 273/169

[58] Field of Search ..... 273/77 A, 167 R-167 B, 273/167 E-167 H, 169

[56] References Cited

U.S. PATENT DOCUMENTS

| | | | |
|---|---|---|---|
| D. 125,455 | 2/1941 | Newsome | D21/220 |
| D. 141,769 | 7/1945 | Newsome | D21/220 |
| D. 164,597 | 9/1951 | Penna | D21/220 |
| D. 234,963 | 4/1975 | Hirata | D21/220 |
| D. 239,778 | 5/1976 | Solheim | D21/217 |
| D. 240,841 | 8/1976 | Solheim | D21/220 |
| D. 241,359 | 9/1976 | Taylor | D21/220 |
| D. 256,264 | 8/1980 | Solheim | D21/220 |
| D. 276,644 | 12/1984 | Solheim | D21/220 |
| 2,007,377 | 7/1935 | Link | 273/167 R |
| 2,062,673 | 12/1936 | Ogg et al. | 273/65 |
| 3,655,188 | 4/1972 | Solheim | 273/77 A |
| 3,845,960 | 11/1974 | Thompson | 273/77 A |
| 3,947,041 | 3/1976 | Barber | 273/167 G |
| 3,961,796 | 6/1976 | Thompson | 273/167 A |
| 3,995,858 | 12/1976 | Cochran et al. | 273/77 A |
| 3,995,864 | 12/1976 | Cochran et al. | 273/164 |
| 3,995,865 | 12/1976 | Cochran et al. | 273/167 F |
| 4,128,242 | 12/1978 | Elkins, Jr. | 273/77 A |
| 4,200,286 | 4/1980 | Bennett | 273/77 A |
| 4,355,808 | 10/1982 | Jernigan | 273/167 H |
| 4,420,156 | 12/1983 | Campau | 273/77 A |
| 4,471,961 | 9/1984 | Masghati et al. | 273/175 |
| 4,512,577 | 4/1985 | Solheim | 273/77 A |
| 4,621,813 | 11/1986 | Solheim | 273/77 A |
| 4,632,400 | 12/1986 | Boone | 273/169 |
| 4,715,601 | 12/1987 | Lamanna | 273/167 H |
| 4,802,672 | 2/1989 | Long | 273/77 A |
| 4,854,581 | 8/1989 | Long | 273/77 A |
| 4,858,929 | 8/1989 | Long | 273/77 A |
| 4,900,028 | 2/1990 | Antonious | 273/169 |
| 4,907,806 | 3/1990 | Antonious | 273/167 F |
| 4,919,431 | 4/1990 | Antonious | 273/167 H |
| 4,921,252 | 5/1990 | Antonious | 273/169 |
| 4,957,294 | 9/1990 | Long | 273/167 H |
| 5,120,062 | 6/1992 | Scheie et al. | 273/167 F |

FOREIGN PATENT DOCUMENTS

| | | | |
|---|---|---|---|
| 2117254 | 10/1983 | United Kingdom | 273/77 A |
| 2165461 | 4/1986 | United Kingdom | 273/169 |

OTHER PUBLICATIONS

Taiwan Sporting Goods Buyers' Guide '89.
Golf Digest, Spalding Executive, May 1972, p. 21.
Golf Digest, Lynx, Apr. 1987, p. 39.
Advertisement for Ping Eye 2, 1991.
Golf World, Dec., 1986, p. 21, top, set of irons, Tommy Armour.
Spalding 1988 Pro Golf Catalog, p. 24, top, golf iron.

*Primary Examiner*—V. Millin
*Assistant Examiner*—Steven B. Wong

[57] ABSTRACT

A golf club head is provided with a cavity which has a pair of side walls which extend at an angle of about 0° to about 50° to the hosel of the club head. The shape of the cavity positions a substantial portion of the weight of the club head in the upper portion of the toe of the club head and in the lower portion of the heel of the club head. The orientation of the weight of the club head provides a substantial moment of inertia about an axis which extends through the center of gravity at an angle of about 45°.

3 Claims, 1 Drawing Sheet

GOLF CLUB HEAD WITH HIGH TOE AND LOW HEEL WEIGHTING

RELATED APPLICATION

This application is a continuation of co-pending patent application entitled Golf Club Head with High Toe and Low Heel Weighting, Ser. No. 558,606, filed Jul. 26, 1990 now U.S. Pat. No. 5,120,062.

BACKGROUND AND SUMMARY

This invention relates to golf club heads of the iron type, and, more particularly, to an iron club head which is provided with a rear cavity which is shaped to position a substantial portion of the weight of the club head high in the toe and low in the heel of the club head.

It is commonly assumed that when a golf club strikes a golf ball off center, i.e., at a point spaced from the center of gravity of the club toward the toe or heel, the club rotates about a vertical axis which extends through the center of gravity. When the club strikes the ball at a point above or below the center of gravity, i.e., toward the top or sole of the club, it is assumed that the club tends to rotate about a horizontal axis which extends through the center of gravity. These assumptions have resulted in clubs being designed with increased polar moments of inertia about the vertical and horizontal axes in order to reduce the rotation of the club. The moment of inertia about the vertical axis may be increased by concentrating weight of the club in the toe and the heel. The moment of inertia about the horizontal axis may be increased by concentrating weight of the club in the sole and the top.

U.S. Pat. No. 4,471,961 states that a golf club head does not rotate about a vertical axis on toe or heel hits and does not rotate about a horizontal axis on high and low hits. Rather, a toe or heel hit will cause the head to rotate about a first axis which extends through the center of gravity of the club head in a plane which intersects the axis of the shaft above the club head. A high or low hit will cause the club to rotate about a second axis which extends through the center of gravity perpendicular to the first axis. If the weight of the club head is distributed to increase the moment of inertia and to decrease the tendency of the club head to rotate, the weight should be distributed with respect to the actual axes of rotation. The true axis of rotation extends at about 35° to about 55° with respect to the horizontal.

U.S. Pat. No. 4,471,961 specifically describes a wood type club head in which the bulge and roll curvatures on the face are oriented with respect to the true axis of rotation Column 6, lines 58–64 refer to an iron club head, but the patent does not describe any specific means for orienting the weight of the club head.

A club head formed in accordance with the invention is provided with a cavity in the back of the club head which has a pair of substantially straight, substantially parallel side walls which extend at an angle from about 0° to about 50° to the hosel of the club head. The resulting shape of the cavity causes a substantial portion of the weight of the club head to be distributed in the upper portion of the toe of the club head and in the lower portion of the heel of the club head. The club head therefore has a significant polar moment of inertia about the true axis of rotation, i.e., an axis which extends through the center of gravity at an angle of about 35° to about 55° to the horizontal.

DESCRIPTION OF THE DRAWING

The invention will be explained in conjunction with an illustrative embodiment shown in the accompanying drawing in which.

DESCRIPTION OF SPECIFIC EMBODIMENT

Figure 1:
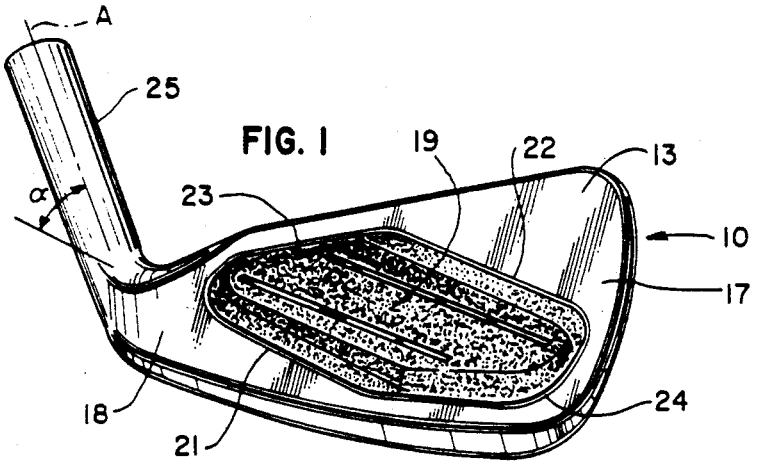
FIG. 1 is a rear view of a club head formed in accordance with the invention.
Figure 3:
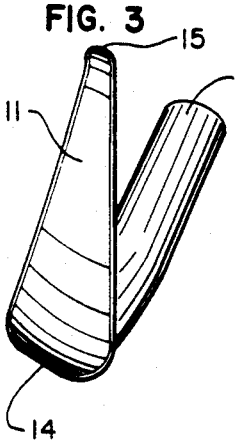
FIG. 3 is an end view of the toe portion of the club head.

The numeral 10 designates generally an iron club head which includes a blade portion 11 and a hosel portion 25 for attaching a shaft (not shown). The blade portion includes a flat front face 12, a back surface 13, and sole surface 14 and top edge surface 15 which extend between the front and back surfaces. The face is provided with parallel grooves 16. The blade portion also includes a toe portion 17 and a heel portion 18 which connects the blade with the hosel.

The club head is oriented in FIGS. 2–7 so that the face 12 lies in the plane of the drawing. In that position the hosel 25 extends at an angle from the vertical in FIG. 3. It will be understood, however, that when the club head is used, at address the hosel will extend in a substantially vertical plane in FIG. 3, and the loft angle of the club head is determined by the angle of the face from the vertical plane when the hosel lies in a vertical plane. The lie angle of the club is determined by the angle between the center line A of the hosel and a horizontal surface H in FIG. 2 on which the center of the sole 14 rests. The center line A and the horizontal reference H intersect at a point B.

The back of the club head is provided with a cavity 19. The cavity is defined by a substantially flat inside wall 20, a pair of substantially straight and substantially parallel side walls 21 and 22, a substantially straight top wall 23, and a bottom wall 24. The inside wall 20 is substantially parallel with the face 12 (see FIGS. 5–7). The top wall 23 extends substantially parallel with the top edge 15. The bottom wall 24 is somewhat U-shaped and follows the contours of the sole and lower toe portion of the club head.

The side walls 21 and 22 of the cavity are oriented so that a substantial portion of the weight of the club head is distributed in the upper portion of the toe 17 and in the lower portion of the heel 18. Since the true axis of rotation of the club head extends through the center of gravity of the club head at an angle of about 35° to about 55° from the horizontal, the side walls 21 and 22 preferably extend at an angle of about 35° to about 55° from the horizontal. Such an orientation of the side walls and the shape of the cavity will ensure that a substantial portion of the weight of the club head is a substantial distance from the axis of rotation so that the club head will have a high moment of inertia about the axis of rotation.

In order to define the orientation of the side walls 21 and 22 with respect to a specific part of the club head, it is helpful to use the centerline A of the hosel. A typical set of iron clubs from the 1 iron through the pitching wedge might have the following lie angles which are determined by the angle between the centerline A and the horizontal:

| Club No. | Lie Angle (degrees) |
|---|---|
| 1 | 56 |
| 2 | 57 |
| 3 | 58 |
| 4 | 59 |
| 5 | 60 |
| 6 | 60 |
| 7 | 61 |
| 8 | 62 |
| 9 | 62 |
| PW | 63 |

The side walls 21 and 22 therefore preferably extend at an angle $\alpha$ (FIG. 1) of about 0° to about 30° to the centerline A of the hosel. In one specific embodiment of a set of clubs, the angle $\alpha$ was increased, primarily for cosmetic reasons. The angle $\alpha$ varied from about 42° to about 45°. It is believed that the angle can be increased to about 50° and still achieve the benefits of the invention.

Figure 2:
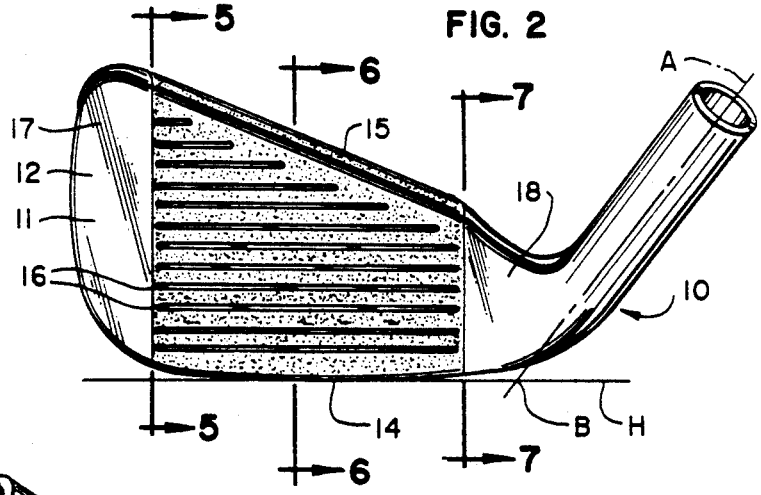
FIG. 2 is a front view of the club head.
Figure 4:
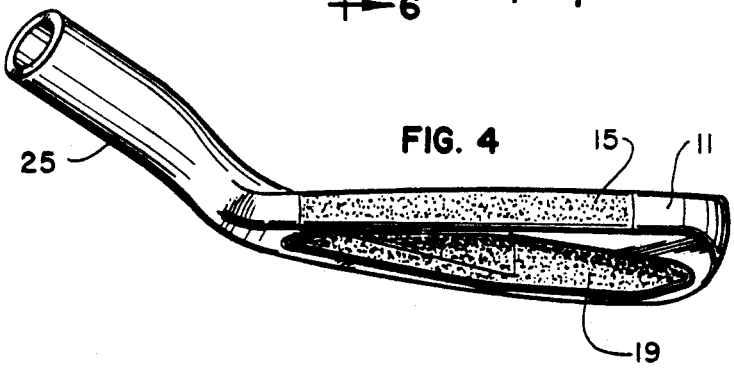
FIG. 4 is a top view of the club head.
Figure 5:
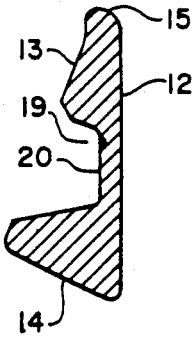
FIG. 5 is a sectional view taken along the line 5—5 of FIG. 2.
Figure 6:
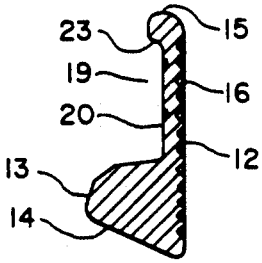
FIG. 6 is a sectional view taken along the line 6—6 of FIG. 2.
Figure 7:
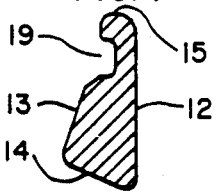
FIG. 7 is a sectional view taken along the line 7—7 of FIG. 2.

The shape of the cavity also permits the center of gravity of the club head to be located in the vertical mid-portion of the club head where the sole is tangent to the horizontal H, i.e., at the section line 6—6 in FIG. 2. The center of gravity is also preferably located at approximately the same distance above the horizontal for each club in the set. In one specific set of clubs formed in accordance with the invention, each club head had the center of gravity located from about 1.25 to about 1.37 inch from the point B in FIG. 2 and from about 0.84 to about 0.90 inch above the horizontal H. The center of gravity is preferably located about 1.34 to about 1.35 inch from point B and about 0.875 inch above the horizontal. The moment of inertia and radius of gyration of the clubs about an axis which extends through the center of gravity at an angle of 45° from the horizontal was:

| Club No. | Moment of Inertia (ounce-inch$^2$) | Radius of Gyration (inches) |
|---|---|---|
| 1 | 8.22 | 0.920 |
| 2 | 8.70 | 0.987 |
| 3 | 9.20 | 1.010 |
| 4 | 9.72 | 1.038 |
| 5 | 10.38 | 1.063 |
| 6 | 11.05 | 1.095 |
| 7 | 12.0 | 1.125 |
| 8 | 13.17 | 1.155 |
| 9 | 14.25 | 1.190 |
| PW | 15.4 | 1.230 |

The relationship between moment of inertia (MOI) and the radius of gyration is defined by the equation $$MOI = \text{mass} \times \text{radius of gyration}$$

The particular set of clubs referred to herein were integrally formed by conventional investment casting techniques. However, the clubs could also be integrally formed by forging. The dimensions listed herein are subject to the normal manufacturing tolerances associated with conventional investment casting and forging techniques.

While in the foregoing specification a detailed description of a specific embodiment of the invention was set forth for the purpose of illustration, it will be understood that many of the details herein given may be varied considerably by those skilled in the art without departing from the spirit and scope of the invention.

We claim:

1. A set of a plurality of integrally formed iron-type golf club heads, each of the golf club heads being identified by a different number and comprising a blade portion and a hosel portion for attaching a shaft to the club head, the blade portion having a flat front face, a back surface, a sole extending between the face and the back surface at the bottom of the blade portion, a toe portion, a heel portion, and a top edge surface which extends from the hosel portion to the toe portion, the blade portion having a cavity formed in the back surface, the cavity having a bottom wall, a top wall, and a pair of side walls, the flat front face of each of the club heads defining a loft angle relative to the hosel which is referred to by the number of the club head, the back surface of the blade portion and the walls of the cavity of each club head being shaped so that sufficient mass of the blade portion is located in an upper portion of the toe portion adjacent the top edge surface and in a lower portion of the heel portion adjacent the sole to provide a moment of inertia of the club head about an axis which extends through the center of gravity of the club head at an angle of about 45° from a horizontal line when the center of the sole is tangent to the horizontal line and the hosel lies in a vertical plane which progressively increases as the loft angle fo the club head increases, the moment of inertia of each number club head of the set having at least the following value:

| Club No. | Moment of Inertia (ounce-inch$^2$) |
|---|---|
| 2 | 8.70 |
| 3 | 9.20 |
| 4 | 9.72 |
| 5 | 10.38 |
| 6 | 11.05 |
| 7 | 12.0 |
| 8 | 13.17 |
| 9 | 14.25 |
| pitching wedge | 15.4. |

2. The set of iron-type golf club heads of claim 1 in which the radius of gyration of the club heads about said axis progressively increases as the loft angle of the club heads increases, the radius of gyration of each number club head of the set corresponding generally to the following radii of gyration for a set of club heads number 2 through pitching wedge:

| Club No. | Radius of Gyration (inches) |
|---|---|
| 2 | 0.987 |
| 3 | 1.010 |
| 4 | 1.038 |
| 5 | 1.063 |
| 6 | 1.095 |
| 7 | 1.125 |
| 8 | 1.155 |
| 9 | 1.190 |
| pitching wedge | 1.230 |

3. The set of iron-type golf club heads of claim 1 in which the center of gravity of each of the club heads is located about 1.25 to 1.37 inch from the intersection of the centerline of the hosel and a horizontal line which is tangent to the center of the sole and about 0.875 inch about said horizontal line.

* * * * *